United States Patent [19]

Mahoney

[11] 4,283,804

[45] Aug. 18, 1981

[54] SWIMMING POOL STRUCTURE

[76] Inventor: Morgan D. Mahoney, P.O. Box 69, Hastings, Ontario, Canada, K0L 1Y0

[21] Appl. No.: 108,715

[22] Filed: Dec. 31, 1979

Related U.S. Application Data

[63] Continuation of Ser. No. 960,185, Nov. 13, 1978, abandoned.

[51] Int. Cl.[3] ..... E04H 3/18

[52] U.S. Cl. ..... 4/506 Q

[58] Field of Search ..... 4/172, 172.19, 172.21, 4/487, 488, 494, 496, 504, 506, 513, 612; 52/223 R, 223 L, 227, 169.7, 169.8, 169.4, 229; 220/71, 1 B

[56] References Cited

U.S. PATENT DOCUMENTS

| | | | |
|---|---|---|---|
| 3,059,243 | 10/1962 | Ross et al. | 4/172.19 |
| 3,335,430 | 8/1967 | Schwarz et al. | 4/172.21 X |
| 3,427,662 | 2/1969 | Jacuzzi et al. | 4/172.19 |
| 3,428,969 | 2/1969 | Diemond et al. | 4/172.19 |
| 3,443,263 | 5/1969 | Minasy | 4/172.19 |
| 3,447,168 | 6/1969 | Gabrielli et al. | 4/172.19 |
| 3,466,676 | 9/1969 | Barrera | 52/169.7 X |
| 3,546,726 | 12/1970 | Hoch et al. | 4/172.19 |
| 3,553,740 | 1/1971 | Gillen | 4/172.19 |
| 3,555,575 | 1/1971 | Schwarz et al. | 52/169.7 X |
| 3,584,319 | 6/1971 | Van Den Brook | 52/169.7 X |
| 4,047,340 | 9/1977 | Witte | 4/172.19 X |

*Primary Examiner*—Stuart S. Levy

[57] ABSTRACT

An above ground pool has straight side wall extents with deck members attached to the extent upper edges. Tension members anchored in aligned deck members adjacent their outer edges allow prestressing of the deck members to prevent outward bowing of deck and side wall members under the weight of water.

5 Claims, 5 Drawing Figures

SWIMMING POOL STRUCTURE

Figure 1:
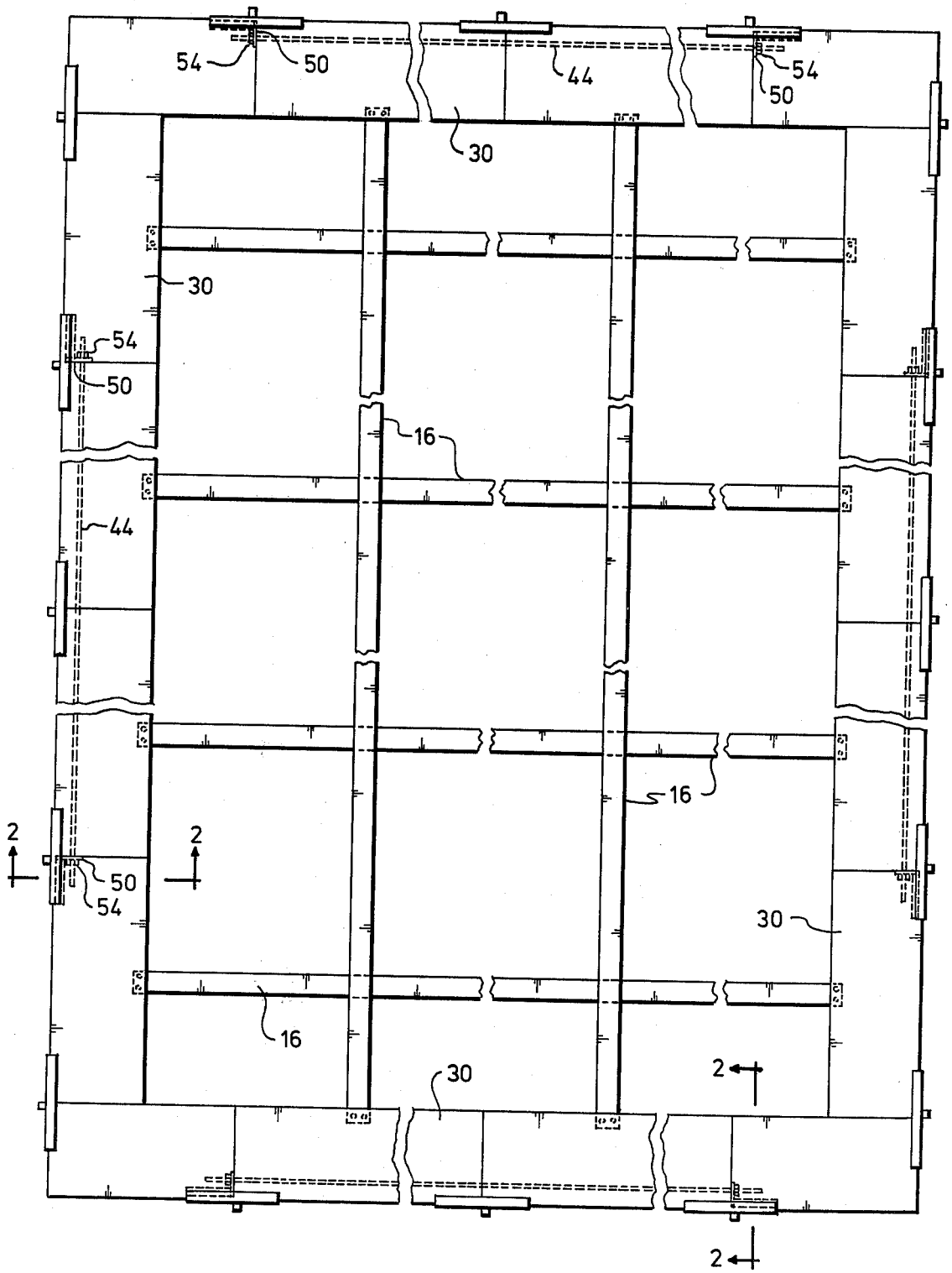

This application is a continuation of application Ser. No. 960,185 filed Nov. 13, 1978, now abandoned.

This invention relates to a framework for an above ground pool.

In an above ground pool, the forces of water pressure tend to bulge the side wall structure outwardly relative to the side wall ends and to bulge the upper portion of the side wall relative to the lower, since the lower portion is customarily retained in position by members joining opposed side walls and running under the water location. Such problems of bulging of the side walls of the pool do not occur where the pool is "in ground" since the earth surrounding the pools then prevents the bulging of the side walls.

Applicant has designed an above ground pool utilizing a deck structure in addition to the side walls proper which avoids the problem of side walls bulging in the two directions discussed above. The inventive construction devised by applicant can be used with members particularly designed for an above ground pool but, in addition, applicant's inventive design allows the adaptation of the side walls (and associated components as described hereafter) of a below ground pool for use as an above ground pool.

The pool to which applicant's invention may be applied comprises side walls, usually vertically disposed, such side walls being substantially straight in plan view. Opposing side walls are joined, at the bottom, by members to maintain the spacing of the side wall bottoms under water pressure. The side wall frame thus designed is seated (as is conventional) on firm levelled ground. A plastic liner (which is conventional and forms no part of the present invention) lines the structure and base, thus defined, to retain the water. Such liner overlies the bottom joining members referred to above and a sand layer is usually placed over such joining members and under the liner. Deck members are attached to straight extents of side walls adjacent the top thereof. These are arranged end-to-end and attached to each other along the tops of the side walls and provide an outwardly extending deck surface for the pool.

The invention, in one aspect provides means to convert the end-to-end deck members, above a side wall, into a rigid structural member by causing them to be prestressed into compression at their outer edges and tension at their inner edges. Such forces tend to make the end-to-end attached deck members bow in slightly. The stresses may be selected so that the inward bow is substantially exactly straightened by the weight of water when the pool is filled. Such prestressing is preferably achieved by locating a tensioning members beneath the deck surface of end-to-end arranged deck structure members and in the outward portion of such deck members. The tensioning means is anchored to the outer portions of spaced deck members in the end-to-end arrangement. Thus, when the tensioning means is tightened, the deck members are prestressed and bowed inwardly as described.

In another aspect of the invention, means are provided to prevent outward bulging of the pool side wall, when viewed parallel thereto, at the junction of the side wall and the deck members. Such outward bulging, as would be seen in horizontal view parallel to the side wall, is avoided by the provision of at least one, and preferably a series of structural members connected to attach at locations, to the outer portion deck structural member, and to the side wall adjacent the bottom thereof. The rigid member has, intermediate the attachment points, means to prevent outward movement of the junction of the side wall to deck members, and upward movement of the outer edge of the deck members.

The invention thus provides, in both aspects, means for converting the combination of a pool side wall and deck members, which are not structurally designed to withstand water pressure without bending, into structural members which will withstand such pressure.

Figure 2:
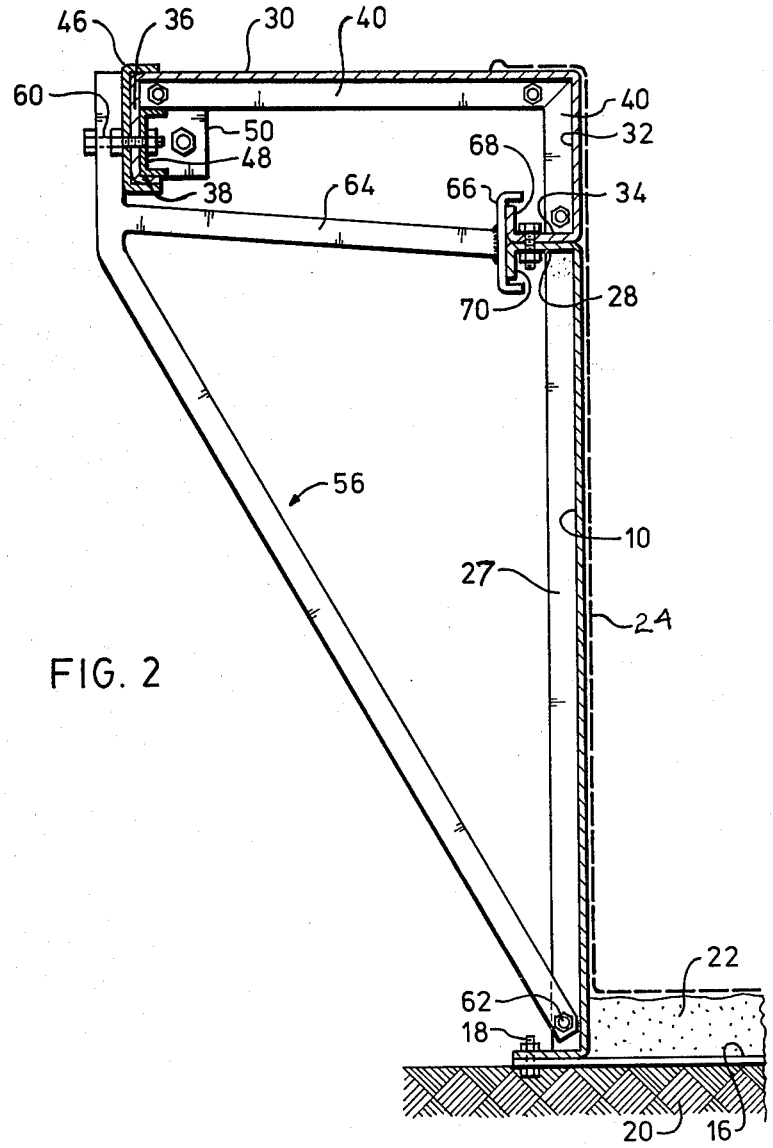
Figure 3:
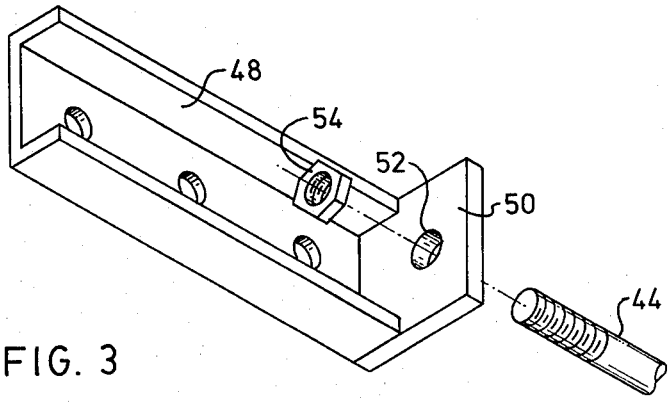
Figure 4:
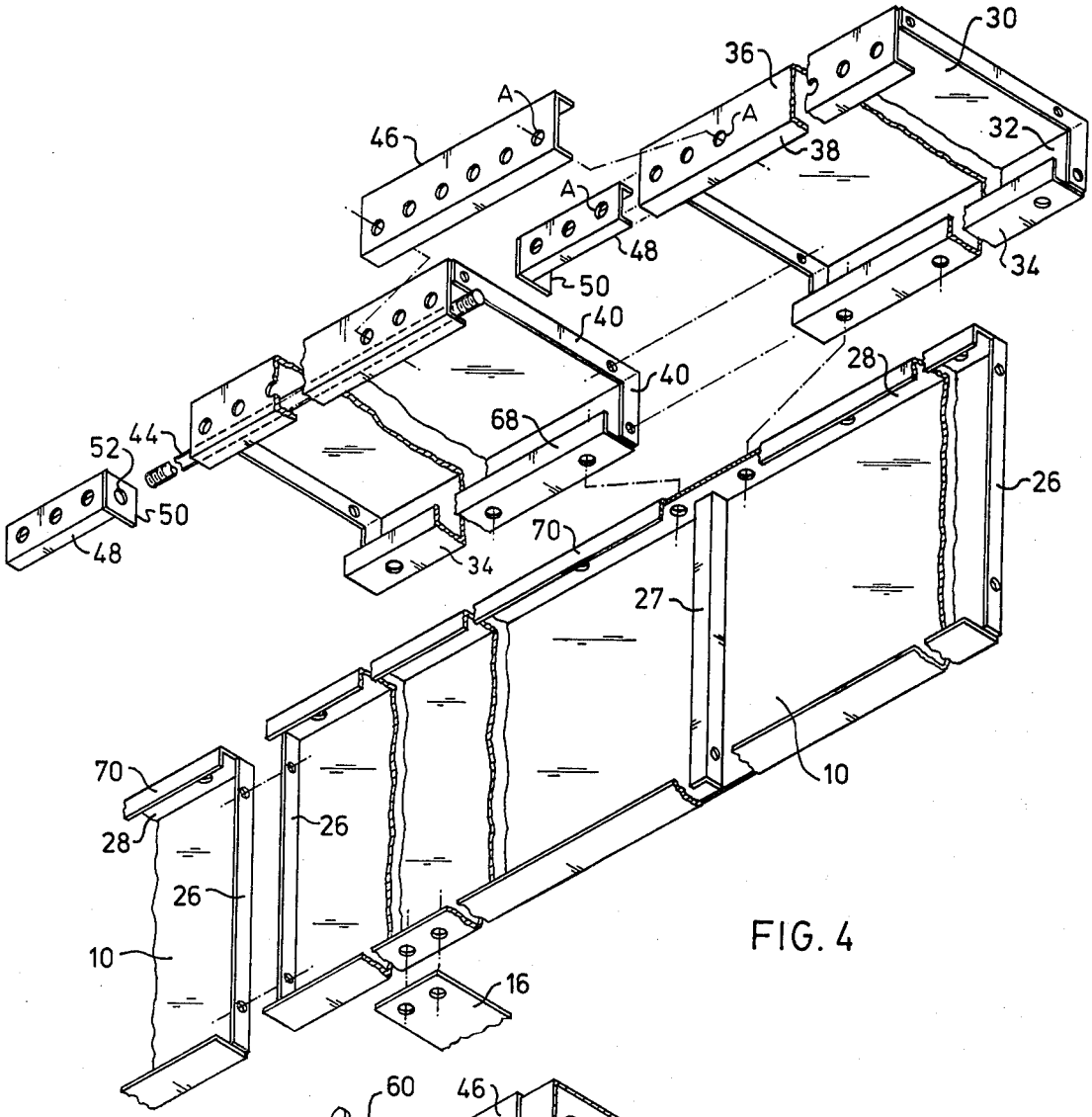
Figure 5:
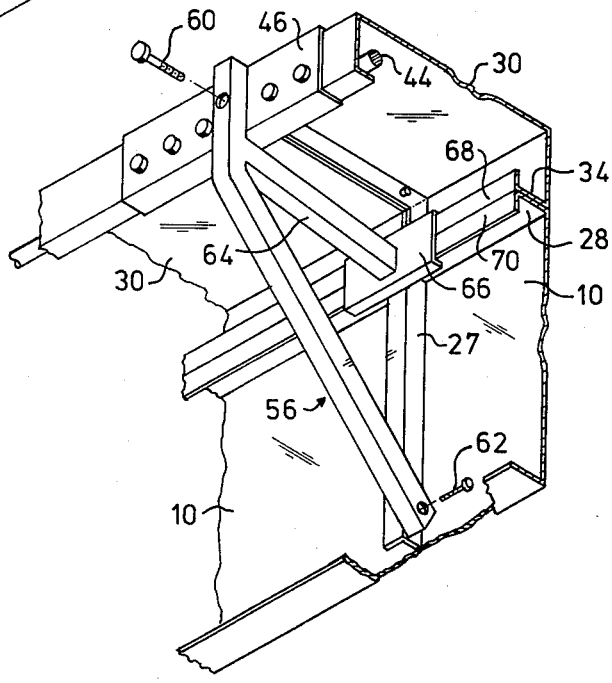

In drawings which illustrate a preferred embodiment of the invention:

FIG. 1 shows a plan view of a pool framework in accord with the invention, without the bottom sand or pool liner, FIG. 2 is a sectional view along either set of lines 2—2 of FIG. 1, FIG. 3 shows a detail view of an element in the structure, FIG. 4 illustrates the connection of the side wall and deck structure, and FIG. 5 shows a rigid figure member attachment to the pool.

In the drawings, FIGS. 1 and 2 may be referred to as showing the basic arrangement of the pool members. Side wall members 10 are shown bolted in abutting relationship to form straight extents of side walls and are suitably joined at the corners (by conventional means, not shown) to form a rectangular pool. As indicated in FIGS. 1 and 3 spreading of the lower ends of the side wall members 10 and side walls by the weight of the water is prevented by structural strips 16 extending across the pool and bolted at 18 to the base of the side wall members, as shown in FIG. 2. If desired, the strips 16 may be omitted and the lower edges of the side wall retained in place by a short peripheral side wall of concrete. The structural rests on firm levelled ground or a concrete base 20 and may be provided, as illustrated in FIG. 2 with a sand layer 22. Lining the pool, but forming no part of the present invention is a plastic liner 24 shown in dotted form, which acts to retain the water in the pool.

As shown in FIG. 4 the side wall members 10 have end flanges 26 and are bolted in abutting relationship with one another by bolts through flanges 26. Side walls members 10 are preferably provided with vertical reinforcing channels 27.

The side wall members 10 (as well as the deck structure members to be described) are fastened at the corners by conventional means, not shown, but well known to those skilled in the art. The upper edge of each side wall member is bent outwardly to form flanges 28 for attachment to the deck members to be described The side walls 10, connected as described comprise a conventional arrangement for a below ground pool. It is the purpose of the invention to convert this arrangement to one which is strong enough to support the water pressure of an above ground pool.

The deck members each are of constant cross section in their longitudinal extension direction and comprise a wall 30 defining a deck surface and designed, in the assembled arrangement of the structure, to extend outwardly from the edge of the pool. The inner edge of the wall 30 is bent downwardly to form a vertical extent 32 which acts as an extension of the pool wall and at the lower end is provided an inwardly bent (relative to the deck structure member) flange 34. Flange 34 is provided with bolt holes in registration with the holes of the top flange 28 of side wall member 10, and for bolting thereto by bolts as shown. The outer edge of the horizontal wall is provided with a short downwardly extending panel 36 terminating at the bottom in an inwardly directed flange 38. The deck members are bolted end-to-end in abutting relationship by means of apertures in end flanges 40 and bolts as shown.

As shown in FIG. 4, it is preferable if the abutting end-to-end joints on the side wall and on the deck are staggered.

As FIG. 1 shows, in general, spaced deck members are provided with anchors for tensioning means 44 which, extending longitudinally parallel to the straight extent of a side wall 10 with its end-to-end abutting, deck members attached. The tensioning means is located in the outer portion, i.e. closer to the outer than the inner edge of the deck member and deck. As a result tension in the tension member creates compression in the outside portion of the end-to-end abutting deck members and tension in the corresponding inside portion. This acts to prestress the end-to-end abutting deck members, corresponding to a straight side wall extent, and the adjacent part of the attached side wall itself, against the water pressure. Preferably the structure is designed so that such prestressing acts to bow the deck members and adjacent portion of side wall slightly inward with the pool empty, the parameters causing such bowing being designed so that the pressure of the predetermined volume of water in the pool substantially straightens the pool wall.

The tensioning means and its spaced anchors may be designed in a number of suitable manners well known to those skilled in the art. However the preferred manner is as shown in the drawings wherein an outer U shaped bracket 46 is bolted on the outside of panel 36 at the abutting joints of the deck members and across those joints. Some of the attaching bolts also attach to complementary U shaped channels 48 on the inside of the panel 36. The inner channel 48, is provided with an end flange 50 directed perpendicular to longitudinal direction of the associated side wall. The end flange is provided with an aperture 52 to receive the end of a tensioning tie rod 44. (All side wall members, deck structure members, are made of suitable sheet steel and the brackets and the tie rod are preferably steel members). The rod 44 is threaded at each end and at each end goes through an aperture 52 in the relevant end flange 50 mounted as above described. Nuts 54 are applied to each end of the rod and may (or one of them may) be tightened to provide the required amount of prestressing and inward bowing to the end-to-end abutting deck members.

It will be noted that although the outer channel 46 attaches to both abutting deck members, the tension member anchoring channel 48 attaches to only one of such members. In the construction of a pool in accord with the invention, the channels 48 and 46 are first bolted to one of the deck members but the other end of channel 46 is left unbolted to the other deck member. The stressing of the deck is then performed by tightening the tension member. The unbolted end of channel 46 is thereafter bolted to the other deck member. The holes in the latter upper deck must, if pre-tapped be arranged to register with the channel 46 holes after the prestressing had taken place.

The main function of outer channel 46 should be noted. In the normal operation and use of the pool the effect of the presence of channel 46 is minimal. However, in the event that a tensioning rod breaks during the use of a filled pool, channel 46 acts to limit the outward bulge of the pool and to reduce the possibility of injury.

There is thus formed by the use of the tensioning means as generally and specifically described above a prestressed structural member out of the deck structure and attached sidewall. Such prestressed structural member prevents the outward bowing under the weight of the water in an outward direction as seen in plan view, i.e. as seen in FIG. 1.

Rigidifying means are provided to prevent outward bowing at the junction of the deck and side wall members in a direction tending to create outward bowing of the otherwise vertical line defined by these members as seen in FIG. 2.

Rigidifying means are provided by the rigid structural member 56 shown in FIG. 2. Junctions at the outer edge of deck member are bolted with the outer U shaped flanges 46 as described in connection with the tensioning means except that inner U-shaped members 48 with end flanges 50 are only provided at the end of the tensioning rod. The rigid member 56 is designed to slope from the lower end of a side wall to the outer portion of a deck and is designed for attachment to the deck by bolting by bolts 60 to the outer deck junction as shown. The lower end of the rigid member is attached to the lower end of a side wall member by bolting at 62 and the upper and lower attachment locations are preferably approximately vertically disposed from each other. Between said attachment locations, the rigid member 56 provides an arm 64 having at its end an inwardly facing channel 66 bears inwardly on and resists outward movement of the junction of the deck and side wall members. The deck and side wall members are, at their junctions, preferably provided with vertically turned flanges 68 and 70 to define a seat for the inwardly facing channel 66, as shown. It is optional but has not been found necessary to positively connect the channel 66 to the junction. If so positively, connected this would of course reduce the inward bowing (but not the prestressing) caused by the tensioning means. The above described arrangement, using the rigid member 56 prevents the deck and side wall from outward bulging relative to the vertical line defined in FIG. 2. Rigid members 56 are supplied at the necessary spacing to supply the necessary strengthening along the lengths of the straight side walls of the pool. The rigid members 56 are preferably attached to the deck and side wall members at a location corresponding to a rigidifying channel 27. Although the rigid member 56 is shown as connected to a joint in the deck members, this will not always be the case and rigid members 56 may be attached to a deck member. The rigid members 56, in addition to their above described purpose, provide a tension member between the lower edge of the side wall member and the outer edge of the deck member, presisting a tendency for the outer edge of the deck member to rotate upwardly under outward water pressure on the side wall.

Although the preferred embodiment shows a single tension member on a side wall and deck, the invention includes the (not preferred) alternative that where, on a side wall and deck, a plurality of tension members were used each bridging one abutting joint of deck members.

I claim:

1. Above ground pool framework comprising:

means defining substantially straight side walls for the pool, means preventing outward movement of the lower portion of such side walls under water pressure, a deck structure comprising members designed to be attached to a side wall adjacent the upper edge of such side wall, said deck members each including a wall arranged to extend approximately horizontally outwardly relative to the side wall to which said deck member is attached, said deck members being arranged end to end along a side wall, said horizontally extending walls corresponding to a side wall, attached together to form a connected unit, tensioning means corresponding to a side wall located beneath said horizontally extending deck wall and attached only at each end to the horizontally extending walls of different deck members attached to the corresponding side wall, said tensioning means extending in a straight line between said ends and generally longitudinally relative to said side walls, said attached ends being located nearer the outer than the inner edge of said horizontally extending deck walls, said tension members being adjustable in length whereby the outer portions of the corresponding deck member horizontal walls may be placed in compression and the inner portion of said horizontal walls placed in tension by shortening said tension members.

2. Framework as claimed in claim 1 wherein said deck members are shaped to be attached in abutting relationship when arranged end to end.

3. Framework as claimed in claim 1 or claim 2 in combination with strengthening means designed to attach to connected deck and side wall members and to prevent outward movement of the junction of a deck member and a side wall relative to the upper end of said deck structure member and the lower end of said side wall members.

4. Framework as claimed in claim 1 or claim 2 in combination with at least one rigid member corresponding to each side wall, located outside said side wall and below said deck surface, said rigid member being connected to a deck member adjacent the outer edge thereof and, to a side wall adjacent the lower edge thereof, said rigid member between said attachment locations being provided with means designed to prevent outward movement of the junction of the attached deck member and the side wall member.

5. Above ground pool framework, comprising:

means defining opposed substantially straight side walls for the pool, means preventing outward movement of the lower portion of such side walls under water pressure, a deck structure comprising members designed to be attached to a side wall adjacent the upper edge of such side walls, said deck members being L shaped having a vertical portion connected at a junction with the upper edge of a side wall and a outwardly extending horizontal wall, said deck members being arranged end to end along a side wall, tensioning means corresponding to each opposed side wall located beneath said horizontal extending wall and attached only at each end to the horizontally extending walls of different deck members attached to the corresponding side wall, said tensioning means extending in a straight line between said ends and generally longitudinally relative to said side walls, said ends being attached nearer the outer than the inner edge of said horizontally extending walls, said tension members being adjustable in length whereby the outer portions of the corresponding deck member horizontal walls may be placed in compression and the inner portion in tension by shortening said tension members, at least one rigid member corresponding to each said opposed side wall attached to said side wall adjacent the bottom thereof, attached to the outer portion of the horizontal wall of a deck member attached to such side wall, and said rigid member, so attached, including means designed to prevent outward movement of the junction between said attached deck structure and attached side wall.

* * * * *